United States Patent [19]

Cobiski

[11] 4,396,012

[45] Aug. 2, 1983

[54] VERTICAL TRACTION HARNESS

[76] Inventor: John Cobiski, Rte. 20, R.F.D. #1, Charlton, Mass. 01507

[21] Appl. No.: 201,212

[22] Filed: Oct. 27, 1980

[51] Int. Cl.[3] ..... A61H 1/02

[52] U.S. Cl. ..... 128/75

[58] Field of Search ..... 128/75, 78, 68, 84 C, 128/71, 69; 272/70, 109, 61

[56] References Cited

U.S. PATENT DOCUMENTS

| | | | |
|---|---|---|---|
| 2,554,337 | 5/1951 | Lampert | 128/78 |
| 2,660,999 | 12/1953 | Thornton | 128/71 |
| 3,167,068 | 1/1965 | Carr | 128/75 |
| 3,374,785 | 3/1968 | Gaylord, Jr. | 128/75 |
| 4,112,935 | 9/1978 | Latyprov et al. | 128/75 |
| 4,125,257 | 11/1978 | Law | 272/109 |
| 4,194,500 | 3/1981 | Grimaldi | 128/75 |
| 4,205,667 | 6/1980 | Gaylord, Jr. et al. | 128/75 |
| 4,269,179 | 5/1981 | Burton et al. | 128/75 |

FOREIGN PATENT DOCUMENTS

| | | | |
|---|---|---|---|
| 919539 | 1/1973 | Canada | 128/75 |
| 716904 | 3/1952 | United Kingdom | 128/75 |

*Primary Examiner*—Richard C. Pinkham
*Assistant Examiner*—T. Brown
*Attorney, Agent, or Firm*—Charles R. Fay

[57] ABSTRACT

A thoracic belt which comprises two separate sections with adjustable connections at the ends thereof to adjust the belt to many sizes of torsos. Each section of the belt is provided with a flexible supporting member, one near the front of the body and one at the back, and having hooks for supporting the belt and user on any kind of support whereby the user can suspend himself and upon flexing the knees, place an upwardly directed or vertical traction force on the thorax relieving pressure on the lower spinal area.

4 Claims, 3 Drawing Figures

VERTICAL TRACTION HARNESS

BACKGROUND OF THE INVENTION

There are many people who have backaches for one reason or another and in many cases if the spinal column should be stretched, pressure is released in the lumbar area and on related muscles and tendons. Continued use, preferably daily, of the present apparatus which accomplishes this function tends to relieve the soreness even when the apparatus is not in use.

SUMMARY OF THE INVENTION

A belt comprises two separate sections which can be connected at their ends to form an encirclement and support for the thorax are preferably made of any suitable strong fabric material with corresponding areas of Velcro to adjustably connect the same together to suit different sizes, accommodating various sizes and shapes of torso. The inner surface of the belt may be made of a cellular synthetic rubber material providing comfort as well as a non-slip surface against the user's skin. The outer surface maybe made of e.g. a vinyl-coated nylon material which provides the needed strength and allows for easy cleaning and stability when used in water. The inner and outer surfaces are bonded securely together and additional nylon strips in inverted V-shapes may be secured to each belt section, with connected D-rings by which the belt can be connected to underarm straps and vertical straps, the latter terminating in hooks.

By this structure, persons of many size variations may assume the belt, hang up the suspending apparatus, and by flexing the knees relieved pressure on the spinal area, the lumbar region. The points of suspense are near the arms, in the shoulder areas, in front and rear of the user, so that the suspense forces are generally equal.

PREFERRED EMBODIMENT OF THE INVENTION

The user generally indicated at 10 is provided with the adjustable belt about his stomach and ribs, i.e., the torso. The belt is of sturdy construction in addition to being adjustable and is provided with straps 14, 16 by which it may be held by an overhead support of any kind as by means of hooks 18. When the user, thus suspended flexes his knees or sags, the belt tends to stretch the body and releases pressure on the spine and the lumbar region, thus alleviating pain whether in the muscles, tendons or the spine.

The user can take as long a treatment as he himself desires or specified lengths of time may be prescribed.

Figure 2:
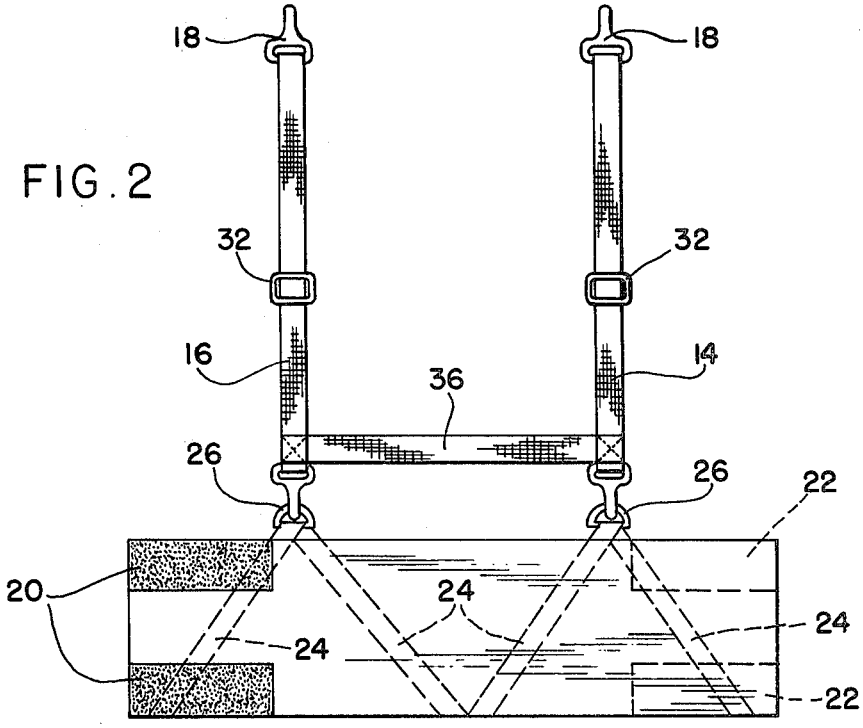
FIG. 2 is a view illustrating one of the sections of the belt.
Figure 3:
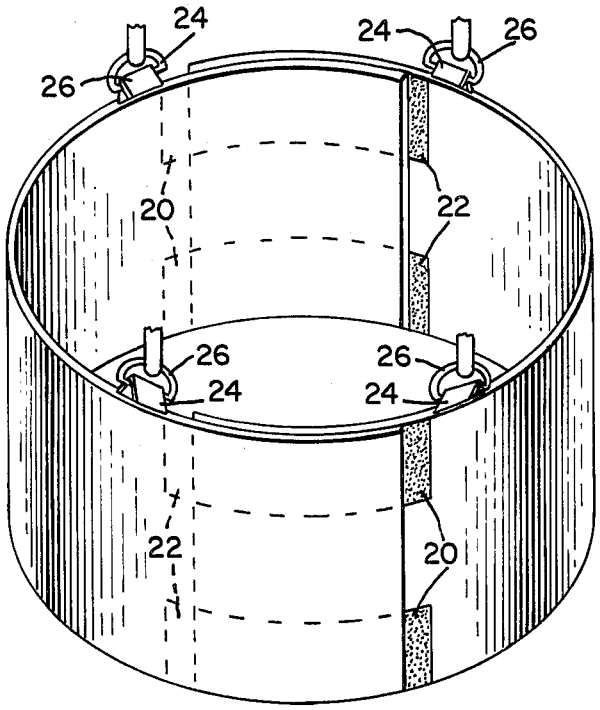
FIG. 3 is a partial perspective view of the invention illustrating two of the sections shown in FIG. 2 connected to form a torso encircling belt.

The belt is in two sections, as shown assembled in FIG. 3, and it is made of suitable material. Each end of each section is provided with Velcro, and referring to FIG. 2, the reference numeral 20 indicates "inside" Velcro and numeral 22 indicates cooperating "outside" Velcro so that it will be seen that two sections are easily secured together under a wide range of adjustment to accommodate torsos of different sizes.

It is preferred that the sections be made of vinyl-coated nylon material at the outside, which provides the needed strength and allows for easy cleaning and stability when used in water, and the inner surface of the belt may be made of a rubber material supplying comfort as well as a non-slip surface against the user's skin.

Figure 1:
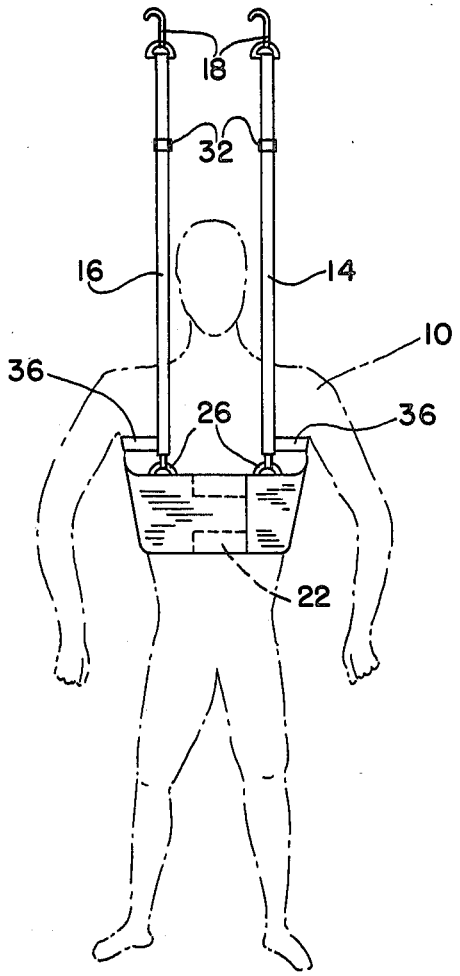
FIG. 1 is a view in front elevation showing the apparatus in use.

Nylon straps in the form of inverted V's are preferably applied between the two layers as indicated at 24. These are securely sewn in and are provided with D-rings or other fasteners 26 at the apexes of the V's. The D-rings may be connected in any way to straps 14, 16 which have hooks 18 at the top ends thereof, together with adjusting buckles or the like 32, and underarm straps 36 connect the straps 14, 16 at the bottom so they will appear as shown in FIG. 1.

The user can adjust the sections to his own taste, hook up the hooks 18 to a prepared support of any kind, not shown, and stay as long as he wants either standing or sagging by merely flexing his knees. Because of the Velcro, the sections can be tapered to fit, as indicated in FIG. 1.

I claim:

1. A torso encircling belt comprising at least two one piece sections of generally flexible material, said sections being alike, adjustable connecting means at the upper edges and in spaced relation at the lower edges at the ends of the sections for adjustably connecting the sections together in a circle to form the belt in different sizes, said connections being identical, means to suspend the belt including support straps arranged intermediate the ends of the sections, said straps being adapted to be located adjacent the sides of the user, for substantially even suspension, the adjustable connecting means on the sections comprising interengaging separable hook-like fibers whereby the sections can be connected at slight angles to each other to provide variable tapers for the belt to better support differing shapes of torso, and an underarm strap for placement about the body under the armpits, said underarm strap being connected at its ends to the support straps.

2. The belt of claim 1 including at least two straps on each section, the arms of the user being receivable between the straps so that the user is suspended front and rear adjacent his sides.

3. The belt of claim 1 wherein the sections comprise a soft inner layer and a strong outer layer.

4. The belt of claim 3 including inverted V-shaped straps secured to the layers and providing connections for the support straps.

* * * * *